United States Patent [19]

Pendry et al.

[11] 4,308,675

[45] Jan. 5, 1982

[54] DISCHARGE VANE ARRANGEMENT FOR SNOW THROWER

[75] Inventors: Warren W. Pendry, Galesburg; Carl E. Seyerle, Abingdon, both of Ill.

[73] Assignee: Outboard Marine Corporation, Waukegan, Ill.

[21] Appl. No.: 127,824

[22] Filed: Mar. 6, 1980

[51] Int. Cl.[3] ..... E01H 5/00

[52] U.S. Cl. ..... 37/43 D; 193/2 A

[58] Field of Search ..... 37/43 R, 43 A, 43 B, 37/43 C, 43 D, 43 E, 43 F, 43 G, 43 H, 43 K, 43 L, 53; 193/2 A

[56] References Cited

U.S. PATENT DOCUMENTS

| | | | |
|---|---|---|---|
| 2,706,864 | 4/1955 | Kear | 37/43 R |
| 2,871,585 | 2/1959 | Merry et al. | 37/53 X |
| 3,359,661 | 12/1967 | Speiser et al. | 37/43 R |
| 3,452,460 | 7/1969 | Cope et al. | 37/53 X |
| 3,466,767 | 9/1969 | Rubin | 37/43 R |
| 4,138,829 | 2/1979 | Chase | 37/43 D |
| 4,138,830 | 2/1979 | Chase | 37/43 D |
| 4,138,831 | 2/1979 | Chase | 37/43 D |
| 4,190,973 | 3/1980 | Schmidt | 37/43 R |

FOREIGN PATENT DOCUMENTS

| | | | |
|---|---|---|---|
| 843101 | 7/1952 | Fed. Rep. of Germany | 37/43 D |

*Primary Examiner*—E. H. Eickholt

*Attorney, Agent, or Firm*—Michael, Best & Friedrich

[57] ABSTRACT

The snow thrower includes an impeller housing carrying an impeller for rotation about a transverse axis and having an upwardly open, forwardly inclined discharge chute through which snow is propelled by the impeller. One or more upwardly extending deflector vanes are disposed in the discharge chute for directing the discharge of snow. Each deflector vane includes a pivot pin which extends rotatably through the transverse rear wall of the discharge chute and a control mechanism, located exteriorly of the discharge chute and connected to the outer ends of the pivot pins, is operable to selectively pivot the deflector vanes between forward, left and right discharge positions.

9 Claims, 4 Drawing Figures

DISCHARGE VANE ARRANGEMENT FOR SNOW THROWER

This invention relates to snow throwers and, more particularly, to walk-behind snow throwers having a rotary impeller for throwing snow upwardly through a discharge chute including directional vanes.

One type of walk-behind snow thrower includes a paddle or blade type impeller for throwing snow upwardly through a discharge chute and a plurality of adjustable deflector vanes in the discharge chute for directing the discharged snow.

Examples of prior art constructions of this type snow thrower are disclosed in the following United States Patents.

| PATENTEE | U.S. Pat. No. | ISSUE DATE |
|---|---|---|
| Kear | 2,706,864 | April 26, 1955 |
| Speiser et al | 3,359,661 | December 26, 1967 |
| Cope et al | 3,452,460 | July 1, 1969 |
| Chase | 4,138,829 | February 13, 1979 |
| Chase | 4,138,830 | February 13, 1979 |
| Chase | 4,138,831 | February 13, 1979 |

The constructions disclosed in the first three patents employ flexible vanes which are rigidly fastened at one end and are flexed or bowed from side to side by applying a force on the other end to change the direction of discharge. In the constructions illustrated in the last three patents, the vanes are pivotally mounted at the upper edge and are pivoted by a control mechanism including parts located inside the discharge chute where they are exposed to snow and foreign objects, such as stones and the like, being propelled through the discharge chute. In the construction disclosed in all of these patents, considerable disassembly and reassembly is required to replace a vane.

SUMMARY OF THE INVENTION

The invention provides a snow thrower comprising a housing carrying an impeller for rotation about a transverse axis and having an upwardly open, discharge chute disposed above the impeller and one or more upwardly extending deflector vanes disposed in the discharge chute for directing the discharge of snow. The discharge chute has a transverse rear wall and the deflector vane includes a pivot pin which extends rotatably through the housing rear wall to afford free pivotal movement of the deflector vane between forward, left and right discharge positions. The deflector vane is selectively rotated between the positions by a control mechanism located exteriorly of the discharge chute and connected to the pivot pin.

In one embodiment, the control mechanism includes an actuating member mounted for reciprocative movement in a direction generally parallel to the rotational axis of the impeller and a connecting arm connected to the deflector vane. One end of the connector arm is connected to the pivot pin for common rotation therewith and the opposite end is connected to the actuating member such that the deflector vane is rotated in response to reciprocative movement of the actuating member.

In another embodiment, the actuating member is reciprocated by a control mechanism including a handle mounted for pivotal movement about an axis generally perpendicular to the longitudinal axis of the actuating member, a lever arm connected to the control handle for common rotation therewith, and a link having one end pivotally mounted on the actuating member and the opposite end pivotally mounted on the lever arm.

In another embodiment, the snow thrower includes a plurality of the discharge vanes disposed in the discharge chute in parallel relationship and a connecting arm connecting each discharge vane to the actuating member so that the discharge vanes are moved in unison between the positions in response to reciprocative movement of the actuating member.

In another embodiment, the outer end portion of the deflector vane pivot pin includes a plurality of radially inwardly movable resilient fingers which snap into an aperture in the connector arm to lock the deflector vane on the connecting arm. A deflector vane can be removed for servicing or replacement by simply squeezing the resilient fingers together to permit removal from the connector arm aperture. Means can be provided for releasably preventing radially inward movement of the fingers and thereby maintain them in a locking position.

One of the principal features of the invention is a provision of a snow thrower including one or more directional discharge vanes which can be conveniently assembled and removed individually.

Another of the principal features of the invention is the provision of a snow thrower including one or more directional vanes in a discharge chute and a control mechanism for adjusting the direction of the vanes located completely exteriorly of the discharge chute.

Other features and advantages of the invention which become apparent to those skilled in the art upon reviewing the following detailed description, the drawings and the appended claims.

Figure 1:
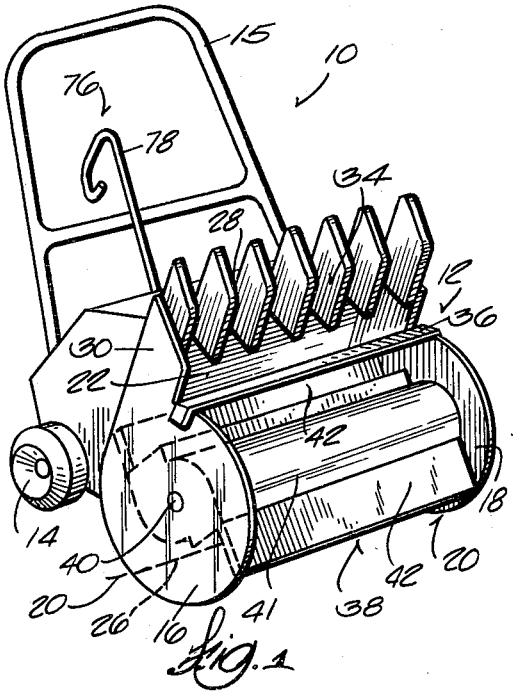
FIG. 1 is a perspective view of a snow thrower embodying various of the features of the invention.

Before explaining at least one embodiment of the invention in detail, it is to be understood that the invention is not limited in its application to the details of the construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Illustrated in the drawings is a lightweight, walk-behind snow thrower 10 including an impeller housing 12 supported on a pair of laterally spaced, ground-engaging wheels 14 (one shown) and a rear handle 15 for guiding movement of the snow thrower. The housing 10 includes a pair of laterally spaced, vertical side walls 16 and 18, each having an arcuate lower portion 20, and a rear wall 22 having a curved bottom portion terminating at the front end in a transverse scraper edge 26. The rear wall 22 includes an upper, forwardly inclined transverse wall portion 28 which cooperates with upper extensions 30 on the side walls 16 and 18 to define a transversely extending discharge chute 34. A cross member 36, connected at the opposite ends to the side walls 16 and 18, serves as a stiffener for the side walls.

Disposed inside the housing 12 for rotation about a horizontal transverse asix is an impeller assembly 38 including a shaft 40 journalled at the opposite ends in the side wall lower portions 20 and supporting a drum-like support assembly 41 carrying a pair of diametrically opposed, axially extending impeller blades 42. The impeller assembly 38 is rotated in a clockwise direction as viewed in FIG. 1 by a suitable power source, such as an internal combustion engine or electrical motor (not shown), through a conventional drive train (not shown).

When an operator walking behind the snow thrower 10 pushes it forwardly into the snow with the impeller assembly 28 operating, the impeller blades 42 bite into the snow and throw the snow upwardly and forwardly through the discharge chute 34. To minimize clogging, the width of the discharge chute 34 preferably is substantially coextensive with the axial length of the impeller blades 42.

Figure 3:
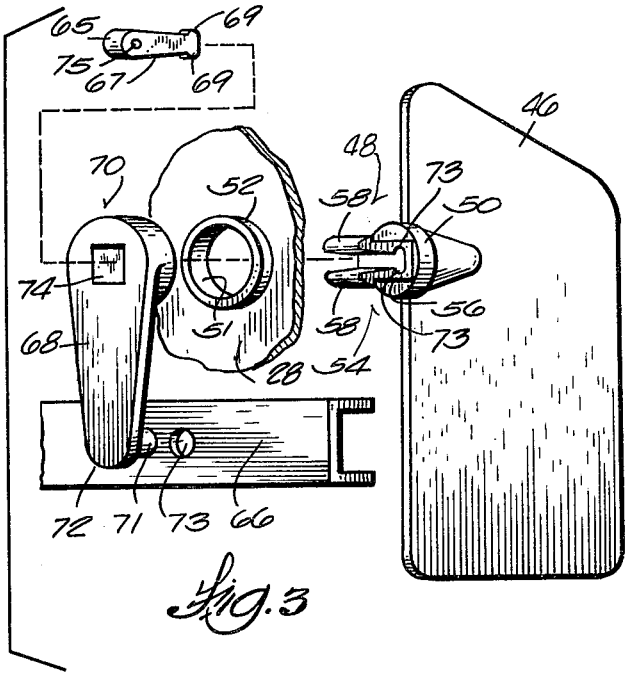
FIG. 3 is an enlarged, exploded view of a deflector vane and some of the components of the position control mechanism, showing the components in position ready for assembly.

The direction of the snow discharged from the discharge chute 34 is controlled by one or more upwardly extending deflector vanes 46 disposed in the discharge chute 34. In the specific construction illustrated, six laterally spaced deflector vanes 46 are provided. The deflector vanes 46 preferably are disposed in parallel relationship and spaced at equal intervals. Means are provided for mounting the deflector vanes 46 on the upper portion 28 of the rear wall 22 to afford free pivotal movement between straight ahead or forward, left and right discharge positions with respect to the operator walking behind the snow thrower 10. While various mounting means can be used for this purpose, in the specific construction illustrated, each deflector vane 46 (FIGS. 3 and 4) is provided with a pivot pin 48 which is journalled in the upper portion 28 of the rear wall 22. Each pivot pin 48 has a cylindrical bearing section 50 which extends through an aperture 51 provided in the rear wall portion 28 and is rotatably received in a cylindrical boss or bushing 52 extending outwardly from the rear wall portion 28.

Each pivot pin 48 also includes an outer end portion 54 having at least two generally flat sides and a plurality (e.g. 2) of resilient, radially spaced fingers 56 which can be moved radially inwardly, i.e. squeezed together. In the specific construction illustrated, the outer end portion of 54 has a generally square cross section. Each finger 56 (FIG. 4) terminates in a nose portion 58 including a tapered outer surface 60 and a radially inwardly extending shoulder 62. The nose portion 58 serves to retain the deflector vane 46 in place as explained below. The deflector vanes 46 preferably are formed as a onepiece unit, such as by molding from a synthetic elastomeric or resinous thermoplastic material.

Figure 2:
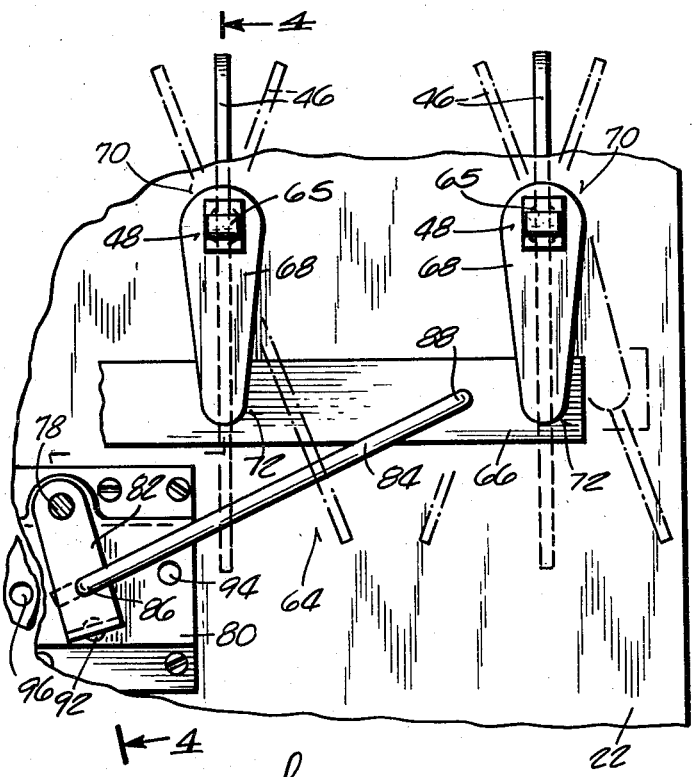
FIG. 2 is an enlarged, fragmentary view of the mechanism for controlling the position of the deflector vanes.

The deflector vanes 46 are selectively rotated in unison from one position to another by a control mechanism located exteriorly of the discharge chute 34 and operatively connected to the pivot pins 48. While various arrangements can be used, in the specific construction illustrated, the control mechanism 64 includes a transversely extending, elongated actuating member 66 mounted for reciprocative movement in a direction generally parallel to the rotational axis of the impeller assembly 38 and a connecting arm 68 for operably connecting each deflector vane 46 to the actuating member 66. While only two connecting arms 68 are shown in FIG. 2 to simplify the drawings, the actual number is six, since there are six deflector vanes 46. One end 70 of each connecting arm 68 is connected to a deflector vane pivot pin 48 for common rotation therewith and the opposite end 72 is pivotally connected to the actuating member 66, such as by a boss 71 on the connecting arm 68 pivotally received in an aperture 73 in the actuating member 66. Thus, the deflector vanes 46 are rotated in unison in response to reciprocative movement of the actuating member 66.

Means are provided for releasably connecting each deflector vane to the respective connecting arm 68 so as to facilitate convenient assembly and removal of individual deflector vanes 46 for servicing and/or replacement. While various arrangements can be used, in the specific construction illustrated, the outer end portion 54 of each pivot pin 48 is provided with a plurality of resilient fingers 56 having a tapered nose portion 58 as described above and the end 70 of each connecting arm 68 is provided with an aperture 74, having the same shape (e.g., square) as a cross section of the outer end portion 54 of the pivot pin 48, for receiving the fingers.

Figure 4:
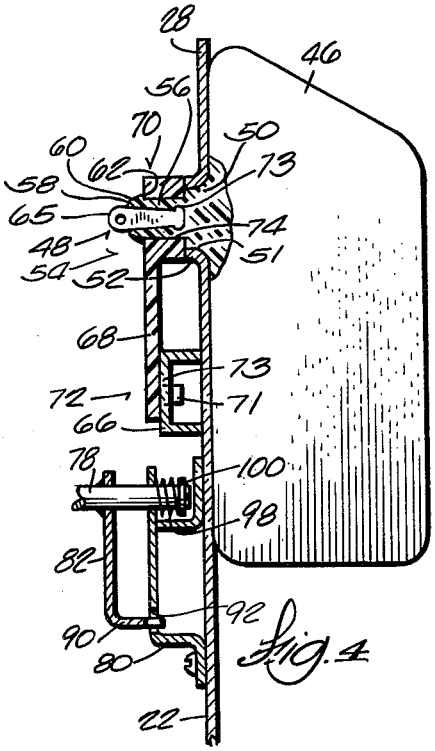
FIG. 4 is a view taken generally along the line 4—4 in FIG. 3.

In assembly, a deflector vane pivot pin 48 is inserted through a rear wall aperture 51 and a bushing 52 and a connecting arm 68 is snapped into place over the outwardly extending nose portions 58 of the fingers 56. That is, the fingers 56 are squeezed radially inwardly towards each other to permit passage of the nose portions 58 through a connecting arm aperture 74, as the inner wall of the aperture 74 cammingly engages the tapered surfaces 60, and the fingers 56 snap back toward their normal position when the nose portions 58 clear the outer surface of the connecting arm 66. The shoulders 62 bear against the outer surface of the connecting arm 68 to lock the connecting arm 68 and deflector vane 46 together as shown in FIG. 4.

Means preferably are provided for releasably preventing radially inward movement of the fingers 56 and thereby maintain them in a locking position. While various arrangements can be used for this purpose, in the specific construction illustrated, such means comprises push members or locks 65 which fits snugly into the space between each pair of fingers 56. Each push lock 56 is installed after the respective deflector vane 46 has been assembled on a connecting arm 68 and includes a tapered body 67 terminating in opposed protrusions 69. The protrusions 69 snap into undercuts 73 provided in the interior surface of the fingers 56 as illustrated in FIG. 4 to retain the push lock 65 in place. In addition to preventing the fingers 56 from unlocking from the connecting arm 68, the push lock 65 increases the structural integrity of the connection between the deflector vane 46 and the connecting arm.

Extending through the head end of the push lock 65 is an aperture 75 for receiving a pin (not shown) or the like to facilitate removal of the push lock when it is desired to remove a deflector vane 46 for replacement or service. To remove a deflector vane 46 the push pin 65 is first removed by pulling thereon. The fingers 56 are then manually squeezed together to permit withdrawal of the pivot pin 48 from the connecting arm aperture 74, through the bushing 52 and through the rear wall aperture 51.

Means are provided for selectively reciprocating the actuating member 66 to adjust the direction of snow discharged from the discharge chute 34. While various arrangements can be used for this purpose, in the specific construction illustrated, such means (FIGS. 1 and 2) includes a control handle 76 having a shank 78 supported for rotational movement, about an axis perpendicular to the longitudinal axis of the actuating member 66, in a bracket 80 mounted on the housing rear wall 22. The control means further includes a lever arm 82 affixed to the control handle shank 78 and a link 84 having one end 86 pivotally mounted on the lever arm 82 and the opposite end 88 pivotally mounted on the actuating member 66. Rotation of the control handle 76 in opposite directions from the forward position shown by the said lines in FIG. 2 causes reciprocative movement of the actuating member 66 and, thus, pivotal movement of the deflector vanes 46 in unison to the left discharge and right discharge positions shown by dashed lines in FIG. 2.

Means preferably are provided for releasably locking the control handle 76 in the forward, left and right discharge positions. In the specific construction illustrated, such means includes an inturned tab 90 on the lever arm 82 which is received in apertures 92, 94 and 96 provided in the bracket 80 and corresponding to the forward, left and right discharge positions, respectively. A coil spring 98 encircling the inner end of the control handle shank 78 with one end bearing against the bracket 80 and the other end bearing against a washer 100 retained on the inner end of the control handle shank 78 biases the lever arm tab 90 into releasable engagement with the apertures 92, 94 and 96. Thus, the lever arm tab 90 acts as a releasable detent. To move the deflector vanes 48 from one position to another, the control handle 76 is first pulled outwardly in a direction perpendicular to the rear wall 22 against the biasing force of the spring 98 to withdraw the lever arm tab 90 from an aperture in the bracket 80 and then rotated, either clockwise or counterclockwise, until the lever arm tab 86 reaches the appropriate aperture in the bracket 80.

Various of the features of the invention are set forth in the following claims.

What is claimed is:

1. A snow thrower comprising a housing carrying an impeller for rotation about a transverse axis and having an upwardly open discharge chute disposed above said impeller and including a transverse rear wall, at least one deflector vane disposed in said discharge chute for directing the discharge of snow propelled upwardly through said discharge chute by said impeller, means pivotally mounting said deflector vane on said rear wall for free pivotal movement between forward, left and right discharge positions, said mounting means including a pivot pin extending from said deflector vane and rotatably through said rear wall and having an end rearwardly of said rear wall, and a control mechanism located exteriorly of said discharge chute and including means located rearwardly of said rear wall and connected to said pivot pin end for rotation thereof so as to selectively pivot said deflector vane between said positions.

2. A snow thrower comprising a housing carrying an impeller for rotation about a transverse axis and having an upwardly open discharge chute disposed above said impeller and including a transverse rear wall, at least one deflector vane disposed in said discharge chute for directing the discharge of snow propelled upwardly through said discharge chute by said impeller, means pivotally mounting said deflector vane on said rear wall for free pivotal movement between forward, left and right discharge positions, said mounting means including a pivot pin extending from said deflector vane and extending rotatably through said rear wall, and a control mechanism located exteriorly of said discharge chute and connected to said pivot pin for selectively pivoting said deflector vane between said positions, said control mechanism including an actuating member mounted for reciprocative movement in a direction generally parallel to the rotational axis of said impeller, a connecting arm having one end connected to said pivot pin for common rotation therewith and an opposite end connected to said actuating member, whereby said deflector vane is rotated between said positions in response to reciprocative movement of said actuating member, and means for selectively reciprocating said actuating member.

3. A snow thrower according to claim 2 wherein said means for reciprocating said actuating member includes a control handle mounted for rotational movement about an axis generally perpendicular to the longitudinal axis of said actuating member, a lever arm connected to said control handle for common rotation therewith, and a link having one end pivotally mounted on said actuating member and the opposite end pivotally mounted on said lever arm.

4. A snow thrower according to claim 2 including detent means for selectively and releasably locking said control handle in one of said positions.

5. A snow thrower according to claim 2 wherein said one end of said connecting arm includes an aperture and wherein said pivot pin includes an outer end portion including a plurality of radially inwardly movable resilient fingers which snap into said connecting arm aperture to lock said deflector vane on said connecting arm.

6. A snow thrower according to claim 5 wherein each of said fingers terminates in a nose portion including a tapered outer surface which cams against the inner wall of said connecting arm aperture during installation of said deflection vane to permit insertion of said nose portion through said connecting arm aperture, said nose portion further including a radially outwardly extending shoulder which, after insertion of said nose portion, returns to a locking position wherein it engages a surface on said connector arm to prevent withdrawal of said pivot pin without squeezing said fingers radially inwardly.

7. A snow thrower according to claim 6 including locking means for releasably preventing radially inward movement of said fingers so as to thereby maintain said fingers in a locking position.

8. A snow thrower according to claim 6 wherein said outer end portion of said pivot pin includes a space between said fingers and said locking means comprises a push member which fits snugly into said space.

9. A snow thrower according to claim 2 including a plurality of said discharge vanes disposed in said discharge chute in parallel relationship and a plurality of said connecting arms respectively connecting each of said discharge vanes to said actuating member whereby said deflector vanes are rotated in unison between said positions in response to reciprocative movement of the actuating member.

* * * * *